US005580110A

United States Patent [19]

Lecourt

[11] Patent Number: 5,580,110

[45] Date of Patent: Dec. 3, 1996

[54] LIFTING RING FOR LATERALLY PICKING UP LOADS

[76] Inventor: Marc Lecourt, 6 rue Buffon, F-72000 Le Mans, France

[21] Appl. No.: 516,469

[22] Filed: Aug. 17, 1995

[30] Foreign Application Priority Data

Aug. 18, 1994 [FR] France ..... 94.10100

[51] Int. Cl.[6] ..... B66C 1/66

[52] U.S. Cl. ..... 294/1.1; 294/89; 403/78

[58] Field of Search ..... 294/1.1, 82.1, 294/89, 82.28; 410/101; 403/78, 119, 164; 248/499

[56] References Cited

U.S. PATENT DOCUMENTS

| | | | |
|---|---|---|---|
| 3,297,293 | 1/1967 | Andrews et al. | 403/164 |
| 4,558,979 | 12/1985 | Andrews | 294/1.1 |
| 4,641,986 | 2/1987 | Tsui et al. | 294/1.1 |
| 4,705,422 | 11/1987 | Tsui et al. | 294/1.1 |
| 5,248,176 | 9/1993 | Fredriksson | 294/1.1 |
| 5,352,056 | 10/1994 | Chandler | 403/78 |

*Primary Examiner*—Dean Kramer
*Attorney, Agent, or Firm*—William A. Drucker

[57] ABSTRACT

The lifting ring includes a shouldered spindle 1 on the threaded body 2 of which a base 3 is screwed and locked by glueing. A crossmember 4 rotates freely on the body 2, thus being held between the internal face 5 of the base 3 and the bottom 6 of the head 7 of the spindle 1. The branches 9,9' of a shackle 10 respectively rotate on the lateral bearing journals 8, 8' of the crossmember 4. The support of each branch 9, 9'on the associated bearing journal 8, 8' is provided by a retaining ring 11 with a circular section fully engaged in a throat with a semi-circular section fitted on the periphery of the bearing journal.

6 Claims, 1 Drawing Sheet

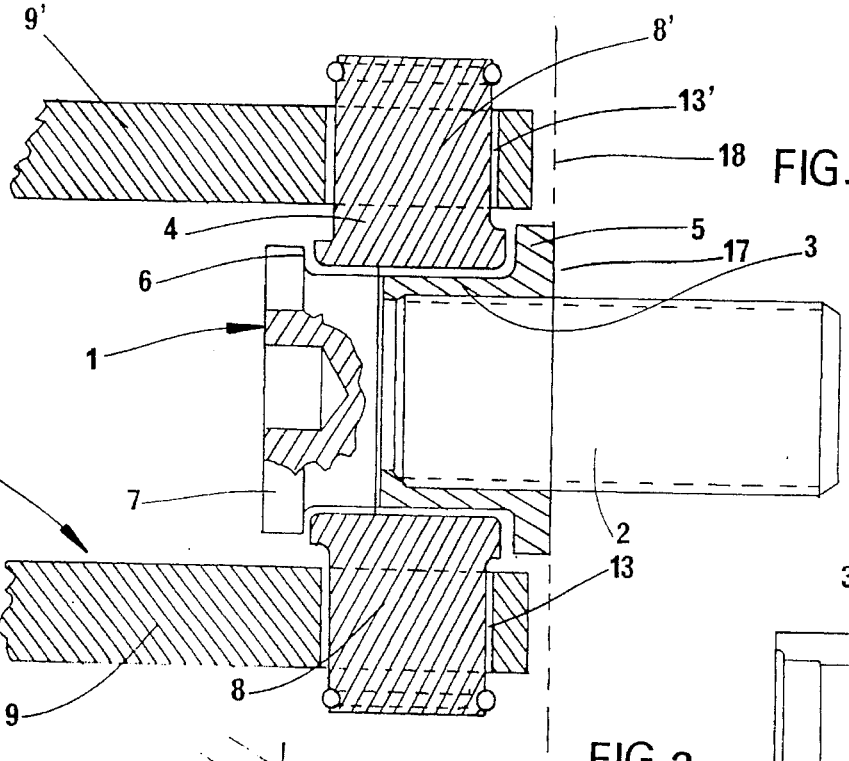
FIG.1
FIG.2
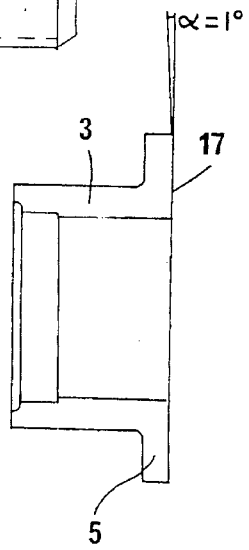
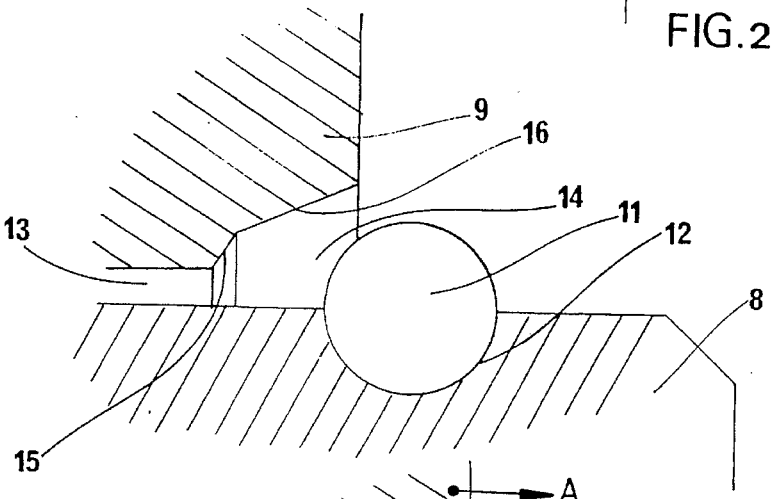
FIG.3
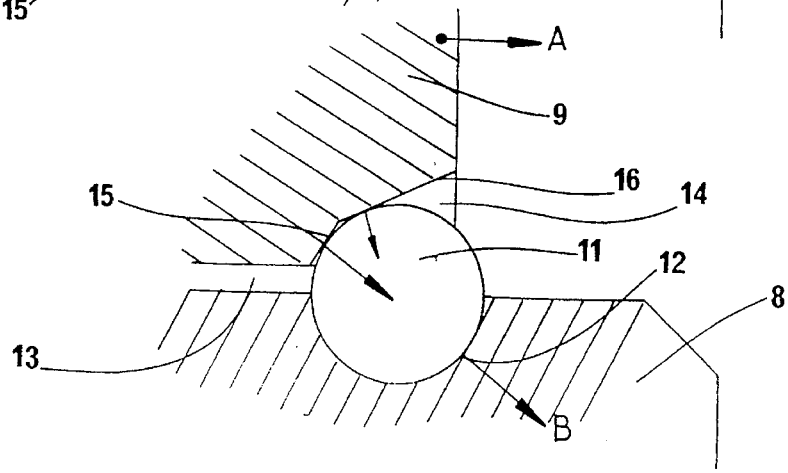
FIG.4

LIFTING RING FOR LATERALLY PICKING UP LOADS

The present invention concerns a lifting ring able to handle a load by being fixed in the tapped holes of the latter, even if these holes are disposed on the side of the load.

So as to permit an easy picking up of the load from slings, the lifting ring screwed into the tapped hole is articulated so as to be used in all possible directions.

These lifting rings have been designed so as to be able to be dismantled which makes it possible, should one of the elements be worn or ruptured, to replace said element. However, the drawback of this dismantle characteristic of this lifting ring resides in the fact that one or several main elements of the ring may then have been removed and, without this being apparent for the user, have been replaced by unsuitable elements of elements of less quality. The user of a lifting ring of this type may thus fear that the ring without him knowing has been modified reducing the performances claimed by the manufacturer and thus reducing safety.

So as to avoid these drawbacks, the present invention offers a non-dismantable lifting ring subject to it undergoing special treatments then permitting visible traces, thus enabling it to be used safely within the limits claimed by the manufacturer.

To this effect, the lifting ring of the present invention includes a shouldered threaded spindle on which a mounted base is screwed and locked, preferably by glueing, a forged monoblock crossmember rotating freely on the spindle kept between the two wings formed by the internal face of the base and by the bottom of the head of the spindle. So as to rotate freely, the extremities of the parallel branches of a shackle are mounted on the extremity journals of the crossmember.

The retaining of the branches of the shackle on the corresponding journals is ensured for each branch by a retaining ring housed in a throat of the extremity of the journal. So that this retention is particularly effective and ensure that the shackle branch can open should the lifting ring is improperly used, the invention offers a mounting which renders the retaining ring self-locking.

To this effect, the shackle branch has on its outer face a housing for receiving the retaining ring and whose upper wall is slanted by about 25°. If the shackle branch is subjected outwardly to a traction force, the slanted wall guides the relative incoming movement of the retaining ring in the housing, the latter then being unable to come out. The resultant of the forces which are then applied to the retaining ring is directed towards the inside of the throat and thus acts to keep the retaining ring inside the throat. Moreover, as the section of the retaining ring is circular, it does not cut the journal in so far that owing to its self-centering, it acts on its entire periphery so that the destruction value of the extremity of the journal shall be at least 2.5 times the maximum use load of the ring, thus leaving a wide margin of safety.

Secondly, according to the invention, the outer face of the base to be applied against the part to be handled has been designed so as to exhibit an extremely slight hollow slope of about 1° which has a large number of advantages:

- possibility of maximum cladding of the base on the wall of the load;
- embodiment of a wear range in cases of intensive usage of the ring;
- extent of the threaded portion of the spindle by the base as far as a maximum limit.

So as to clearly understand the invention, there now follows a non-restrictive example of a preferred embodiment with reference to the accompanying diagrammatic drawing on which:

FIG. 1 is a longitudinal vertical cutaway view of a lifting ring conforming to the present invention;

FIG. 2 is on larger scale a longitudinal section of the base, and

FIGS. 3 and 4 are detailed vertical cutaway views on larger scale showing the self-locking joint system respectively in normal use and when applying traction to the shackle branch.

With reference to FIG. 1, this figure shows a non-dismantle lifting ring of the invention and which includes a shouldered spindle 1 on the threaded body 2 of which a tapped support base 3 is screwed. A forged monoblock crossmember 4 is mounted so as to rotate freely by being supported between the two wings formed firstly by the internal face 5 of the base 3 and secondly by the bottom 6 of the head 7 of the spindle 1.

As the base 3 is not dismantle in normal conditions, for this purpose it is locked by glueing onto the body 2 so that a dismantling would be possible only by heating at a high temperature (more than 250° C.) to neutralize the glue or by means of destruction which in either case would certainly leave visible traces.

The branches 9,9' of a shackle 10 respectively rotate on the literal journals 8,8' of the crossmember.

As shown in more detail on FIGS. 3 and 4, the keeping of the branch 9 on the journal 8 is ensured by a retainer ring 11 with a circular section and partially engaged in a throat 12 with a semicircular section fitted inside the periphery of the journal 8.

Towards the outside, the opening 13 of the branch 9, which is traversed by the journal 8, is followed by a housing 14 delimited by a short wall 15 slanted along an angle of about 45° which is followed by an elongated wall 16 with an inclination of about 25°.

As can be seen of FIG. 4, if a traction force is applied to the branch 9 in the direction of the arrow A so as to tend to make this branch open for it to escape from the journal 8, the slanted wall 16 forces the journal 8 to be centered in the housing 14 and the retaining ring 11 is captured, thus being unable to escape from the throat 12.

Again FIG. 4 also shows that the resultant B of the forces applied exerts a cutting force to the extremity of the journal 8. However, having regard to the round section of the retaining ring 11, the action of cutting the latter shall be slight and, so as the ind of the journal 8 if destroyed, it is therefore necessary that the traction force A reaches much larger values so that the retaining ring 11 owing to its self-centering shall act over its entire periphery. This disposition makes it possible to reach a destruction value of the extremity of the journal which is still greater than 2.5 times the maximum use load of the ring.

As can be seen in more detail on FIG. 2, the outer face 17 of the support base 3 exhibits an extremely slight slant towards the inside by an angle$\propto$=1°, which enables the ring to be clad as much as possible against the outer face (diagrammatized by the dotted lines at 18 on FIG. 1 ) of the load, despite the possible inequalities exhibited by the latter.

The slight inclination mentioned above of the outer face 17 of the base 3 makes it possible to ensure a wear range of the latter when the lifting ring is used intensively, thus improving the period of life of the ring.

This disposition also ensures that the threaded portion of the body 2 of the spindle 1 is borne by the base 3 up to its maximum limit. It also makes it possible to have a threaded spindle 2 having a constant section in the zone where it shall work on shearing when the traction force is exerted on the ring in an oblique direction or at 90°. The end of the threading is then mounted inside and working on shearing is no longer possible.

The description given above has been given simply by way of non-restrictive example and constructive modifications or additions could be made without departing from the context of the invention.

I claim:

1. Load lifting ring which comprises:

(a) a spindle having a threaded body to be screwed in a tapped hole of a load to be handled, and a head having radially projecting portions, (b) a tapped support base screwed onto said threaded body and locked on this body by gluing, said tapped support base having radially projecting portions disposed opposite said radially projecting portions of said spindle head, (c) an intermediate forged monoblock part mounted to rotate 360° around said spindle, said intermediate part rotating around said support base and being kept axially between said radially projecting portions of said head and of said support base, and (d) a hooking loop pivoting 360° around spindles radially projecting from said intermediate part.

2. Load lifting ring according to claim 1 wherein a face of said support base to be applied against the load to be handled slants slightly inwardly by an angle of about 1°.

3. Loading lifting ring according to claim 1 wherein a retaining ring is engaged in a peripheral throat provided in each one of said spindles of said intermediate part, said retaining ring preventing a branch of said hooking loop to escape from said spindle.

4. Load lifting ring according to claim 3 wherein said branch of said hooking loop comprises an opening traversed by said spindle of said intermediate part and presents in an outer face and in the vicinity of said opening, a housing in which said retaining ring is centered when a traction force is applied approximately perpendicular to said branch.

5. Load lifting ring according to claim 4 wherein said housing has a wall slanted by about 25°, said wall being used to guide the retaining ring and to transmit thereto a force in a direction tending to keep said retaining ring in said throat.

6. Load lifting ring according to claim 3 wherein said retaining ring has a circular cross-section.

* * * * *